US007874366B2

(12) United States Patent
Allcorn et al.

(10) Patent No.: US 7,874,366 B2
(45) Date of Patent: Jan. 25, 2011

(54) PROVIDING A CLEANING TOOL HAVING A COILED TUBING AND AN ELECTRICAL PUMP ASSEMBLY FOR CLEANING A WELL

(75) Inventors: Marc Allcorn, Sugar Land, TX (US); Jing Hayes Chow, Anchorage, AL (US); David Milton Eslinger, Collinsville, OK (US); Matthew R. Hackworth, Manvel, TX (US); John David Rowatt, Pearland, TX (US); Thomas Allan, Hosuton, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 198 days.

(21) Appl. No.: 11/770,416

(22) Filed: Jun. 28, 2007

(65) Prior Publication Data

US 2008/0066920 A1 Mar. 20, 2008

(51) Int. Cl.
*E21B 43/00* (2006.01)

(52) U.S. Cl. ..... 166/311; 166/105

(58) Field of Classification Search ..... 166/385, 166/311, 99, 105
See application file for complete search history.

(56) References Cited

U.S. PATENT DOCUMENTS

| | | | | |
|---|---|---|---|---|
| 4,069,871 | A | 1/1978 | Page, Jr. | |
| 4,711,299 | A * | 12/1987 | Caldwell et al. | 166/105.1 |
| 4,940,092 | A * | 7/1990 | Ferguson et al. | 166/311 |
| 5,078,213 | A * | 1/1992 | Canutt | 166/369 |
| 5,170,815 | A | 12/1992 | Going | |
| 6,189,617 | B1 * | 2/2001 | Sorhus et al. | 166/311 |
| 6,192,983 | B1 * | 2/2001 | Neuroth et al. | 166/250.15 |
| 6,216,788 | B1 * | 4/2001 | Wilson | 166/311 |
| 6,220,347 | B1 * | 4/2001 | Head | 166/105.3 |
| 6,260,627 | B1 * | 7/2001 | Rivas | 166/369 |
| 6,330,915 | B1 * | 12/2001 | Moya | 166/265 |
| 6,352,113 | B1 * | 3/2002 | Neuroth | 166/301 |
| 6,666,269 | B1 * | 12/2003 | Bangash et al. | 166/310 |
| 6,834,722 | B2 | 12/2004 | Vacik | |
| 6,883,605 | B2 | 4/2005 | Arceneaux | |
| 6,889,771 | B1 | 5/2005 | Leising | |
| 2002/0100585 | A1 | 8/2002 | Spiers | |
| 2003/0198562 | A1 * | 10/2003 | Blauch et al. | 417/423.3 |
| 2005/0045343 | A1 * | 3/2005 | Bixenman et al. | 166/385 |
| 2008/0066920 | A1 | 3/2008 | Allcorn et al. | |

FOREIGN PATENT DOCUMENTS

| | | | |
|---|---|---|---|
| EP | 1852571 | A1 | 11/2007 |
| GB | 2362407 | A | 11/2001 |
| GB | 2391239 | A | 2/2004 |
| WO | 0058602 | A1 | 10/2000 |
| WO | 0173261 | A2 | 10/2001 |

* cited by examiner

*Primary Examiner*—William P Neuder
(74) *Attorney, Agent, or Firm*—Michael L. Flynn; David Hofman; Robin Nava

(57) ABSTRACT

To perform a cleanout operation in a wellbore, a cleaning tool having a coiled tubing and an electrical pump assembly is run into the wellbore. The electrical pump assembly that is located in the wellbore is activated. In response to fluid flow generated by the electrical pump assembly, removal of debris from the wellbore is caused by directing fluid containing the debris into the coiled tubing for delivery to an earth surface.

24 Claims, 4 Drawing Sheets

PROVIDING A CLEANING TOOL HAVING A COILED TUBING AND AN ELECTRICAL PUMP ASSEMBLY FOR CLEANING A WELL

TECHNICAL FIELD

The invention relates generally to providing a cleaning tool having a coiled tubing and electrical pump assembly for cleaning debris from a wellbore.

BACKGROUND

The statements in this section merely provide background information related to the present disclosure and may not constitute prior art.

At various stages of operation in a wellbore, such as after drilling, after completion, after an intervention operation, and so forth, debris may be generated in the wellbore. Examples of debris include sand particles or other particulates, and/or other solid debris. A well cleanout operation can be performed as a workover operation to remove such debris from the wellbore. Typically, a gelled water-based fluid is provided down a coiled tubing, with return fluid received in an annulus region outside the coiled tubing, where the return fluid contains suspended debris material.

Conventional cleanout operations can work well when a well reservoir is at a sufficiently high pressure. However, in certain wells, a well reservoir can have a relatively low pressure such that the well reservoir is unable to support a full column of water-based fluid. One technique for performing cleanout in an under-pressure well is to use a nitrogen-based foam as a service fluid. A foam has low density so that return fluid can be circulated to the earth surface even in a low-pressure well, and a foam has relatively good solid suspension properties. However, nitrogen-based foam is relatively expensive, and is not readily available in remote areas.

Another conventional technique of conducting well cleanout in an under-pressure well is to use concentric strings of coiled tubing, where two coiled tubings are concentrically provided and deployed into a well. Gelled water-based fluid (fluid in which a viscous material has been added to enhance viscosity of the fluid) can be provided down one conduit of the two-coiled tubing assembly and return fluid with suspended debris is circulated back to the earth surface through the other conduit of the two-coiled tubing assembly. However, running an assembly that includes two coiled tubings is associated with various issues, including increased weight, increased difficulty of transportation, and increased costs.

SUMMARY

In general, according to an embodiment, a method for use in a wellbore includes running a cleaning tool having a coiled tubing and an electrical pump assembly into the wellbore, and activating the pump assembly that is located in the wellbore. In response to flow generated by the pump assembly located in the wellbore, removal of debris from the wellbore is caused by directing fluid containing the debris into the coiled tubing for flow to an earth surface.

Other or alternative features will become apparent from the following description, from the drawings, and from the claims.

DETAILED DESCRIPTION

Figure 1:
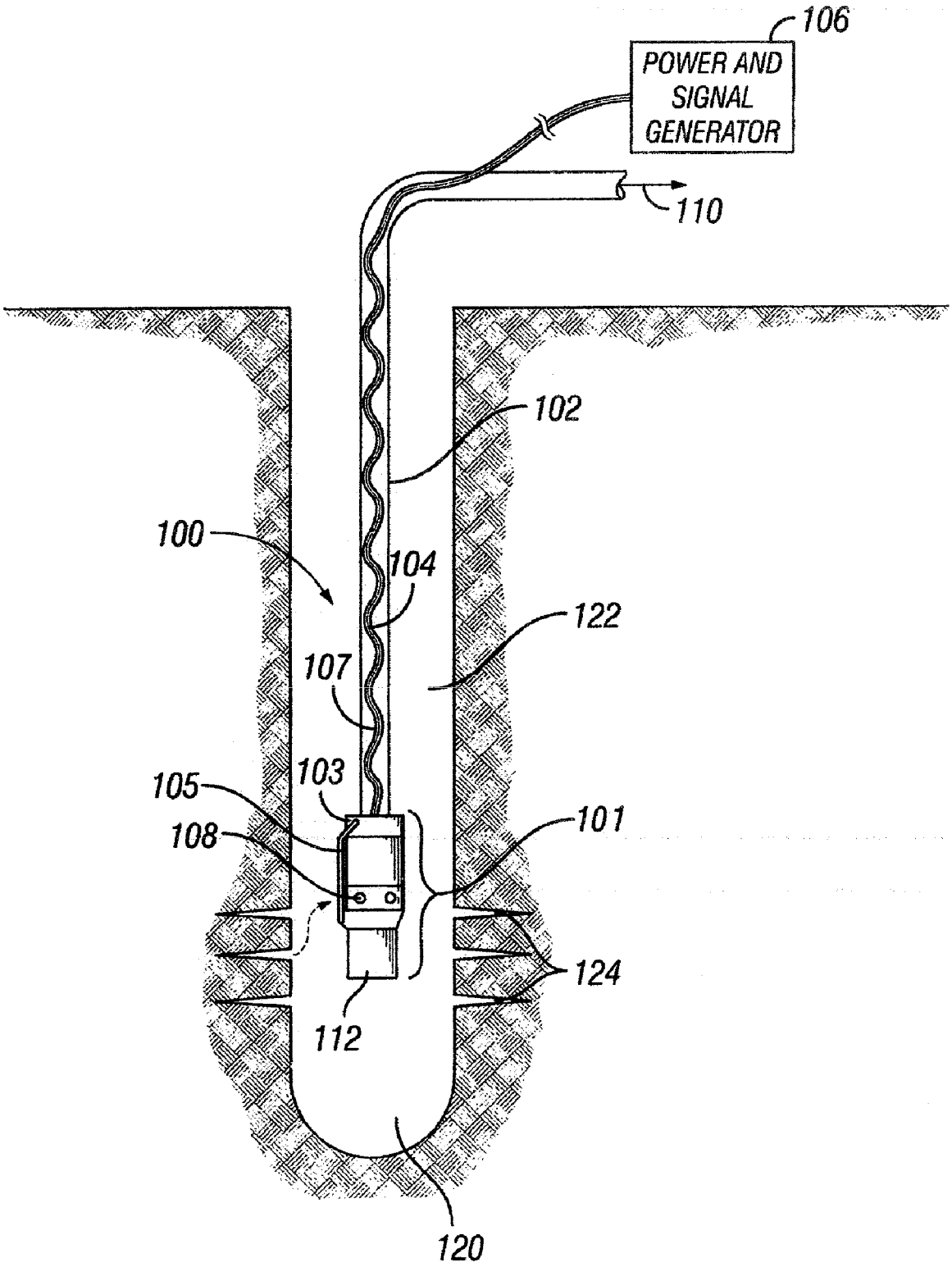
FIG. 1 illustrates a cleanout tool (or cleaning tool) that has a coiled tubing and a pump assembly deployable to a wellbore, according to an embodiment.

At the outset, it should be noted that in the development of any such actual embodiment, numerous implementation—specific decisions must be made to achieve the developer's specific goals, such as compliance with system related and business related constraints, which will vary from one implementation to another. In the following description, numerous details are set forth to provide an understanding of the present invention. However, it will be understood by those skilled in the art that the present invention may be practiced without these details and that numerous variations or modifications from the described embodiments are possible. Moreover, it will be appreciated that such a development effort might be complex and time consuming but would nevertheless be a routine undertaking for those of ordinary skill in the art having the benefit of this disclosure.

As used here, the terms "above" and "below"; "up" and "down"; "upper" and "lower"; "uphole" and "downhole"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a cleanout tool (also referred to as a "cleaning tool") is deployed into a wellbore to perform cleanout operations by removing debris from the wellbore. The wellbore may be part of a single-wellbore well, or part of a multilateral well. As a result of various well operations that are conducted in the wellbore, debris may be generated in the wellbore. Examples of debris include formation particulates such as sand or other particulates, solid debris particles created by tools run into the wellbore, and/or other debris. If left in the wellbore, the debris may have an adverse effect on future well operations, including production or injection operations.

The cleaning tool according to some embodiments for performing the cleanout operation includes a coiled tubing and an electrical pump assembly attached to the coiled tubing. A coiled tubing refers to a conveyance structure, generally tubular in shape, that can be continuously deployed into a wellbore, such as from a spool. A coiled tubing is different from tubings or pipes which are deployed into the wellbore in segments that are attached together.

An electrical pump assembly refers to an assembly having a device (powered electrically by a downhole power source or a power source delivered over a cable from the earth surface) that is electrically operated to move fluid in one or more fluid channels. In some embodiments, the pump assembly is attached to a most distal end of the coiled tubing, where the "distal" end of the coiled tubing refers to the end of the coiled tubing that is provided farthest from the earth surface when the coiled tubing is deployed into the wellbore.

The pump assembly that is located in the wellbore is activated to cause a flow of fluid containing suspended debris particles to be generated in the wellbore. In some embodiments, the flow of fluid that contains debris particles can be directed into an inner conduit of the coiled tubing by the electrical pump assembly. The fluid containing the debris particles can then be flowed upwardly in the coiled tubing inner conduit towards the earth surface.

By using a cleaning tool with a coiled tubing and an electrical pump assembly attached to the coiled tubing, cleanout operations can be performed in an under-pressure well that has a reservoir with a relatively low pressure.

In one example, the electrical pump assembly includes an electrical submersible pump (ESP). An ESP is a pump that can be submerged in liquid (e.g., wellbore liquids) to provide lift for moving the liquid uphole in the wellbore. Another example electrical pump assembly includes a progressive cavity pump. A progressive cavity pump is a pump that transfers fluid by moving the fluid through a sequence of cavities as a rotor of the progressive cavity pump is turned. In other implementations, other types of pumps can also be used.

FIG. 1 illustrates a cleaning tool 100 according to a first embodiment that has a coiled tubing 102 and an electrical pump assembly 101 attached to the end of the coiled tubing 102. The cleaning tool 100 is deployed in a wellbore 120. The electrical pump assembly 101 is electrically connected to an electrical cable 104 that extends in an inner conduit 107 of the coiled tubing 102. In an alternative implementation, the electrical cable 104 can extend outside the coiled tubing 102. In yet another implementation, the coiled tubing can be a wired tubing having one or more conduits formed in the wall of the coiled tubing through which electrical conductor(s) of the cable 104 can extend along the length of the coiled tubing.

The electrical cable 104 extends from the electrical pump assembly 101 to the earth surface through the coiled tubing 102. The upper end of the cable 104 is connected to a power and signal generator 106 for providing power and control signaling (for activation or deactivation) to the pump assembly 101.

The pump assembly 101 includes a pump 103, an electrical motor 112, and an electrical cable segment 105 to electrically connect the motor 112 to the electrical cable 104. The pump assembly 101 also has inlet ports 108 for receiving fluid containing suspended debris particles. When the motor 112 is activated, fluid containing debris particles is drawn through the inlet ports 108 into the pump 103, with the fluid carrying the debris directed into the inner conduit 107 of the coiled tubing 102. The fluid containing the debris is lifted in the coiled tubing 102 by the pump 103 towards the earth surface, where the fluid exits from the coiled tubing 102 as return fluid 110.

The motor 112 is electrically activated and can be powered by the power generator 106 at the earth surface. Alternatively, instead of providing power from the earth surface, an alternative implementation uses a downhole power source at the pump assembly 101 to allow power to be provided to the motor 112.

In operation, the cleaning tool 100 is run into the wellbore 120. At some point, such as when the cleaning tool 100 has been lowered to a desired depth in the wellbore 120, the pump assembly 101 is activated (by providing power and control signaling over the cable 104, for example) to start the flow of fluid. Activating the pump assembly 101 causes fluid containing suspended debris particles to be drawn through the inlet ports 108 into the inner conduit 107 of the coiled tubing 102 for flow to the earth surface. In some implementations, a gelled fluid can be spotted in an annulus region 122 between the coiled tubing 102 and the inner wall of the wellbore 120 (which in some cases can be lined with casing). "Gelled fluid" refers to fluid into which a viscous material has been added for enhancing the viscosity of the fluid. The viscous material helps to suspend debris particles in the fluid to allow the debris particles to be carried to the earth surface, even at relatively slow fluid flow rates.

The cleaning tool 100 can be continuously moved in the wellbore 120, either in a downwardly direction or upwardly direction, as the pump assembly 101 is drawing fluid containing debris material into the coiled tubing inner conduit 107. In this way, debris particles can be removed as the cleaning tool 100 is moved continuously in the wellbore 120. Alternatively, the cleaning tool 100 can remain stationary in the wellbore 120 to perform the cleanout operation.

Although not depicted, it is noted that in some example implementations, the cleaning tool 100 can actually be run through a production tubing that is deployed in the wellbore 120. The production tubing can be omitted in other implementations. The cleaning tool 100 is considered an intervention tool that is run into the wellbore 120 for performing an intervention or workover operation, in this case a cleanout operation. After completion of the task, the cleaning tool 100 is removed from the wellbore 120 to allow for normal operation of the wellbore (e.g., production of hydrocarbons from surrounding reservoir through perforations 124 in the reservoir, or injection of fluids through the wellbore 120 into the surrounding reservoir).

By using cleaning tools according to some embodiments, such as the cleaning tool 100 of FIG. 1, various benefits can be provided. For example, a relatively inexpensive gelled water-based fluid can be used without causing significant fluid loss to the formation. Moreover, a single-coiled tubing string can be used to conduct return fluid to the earth surface.

Figure 2:
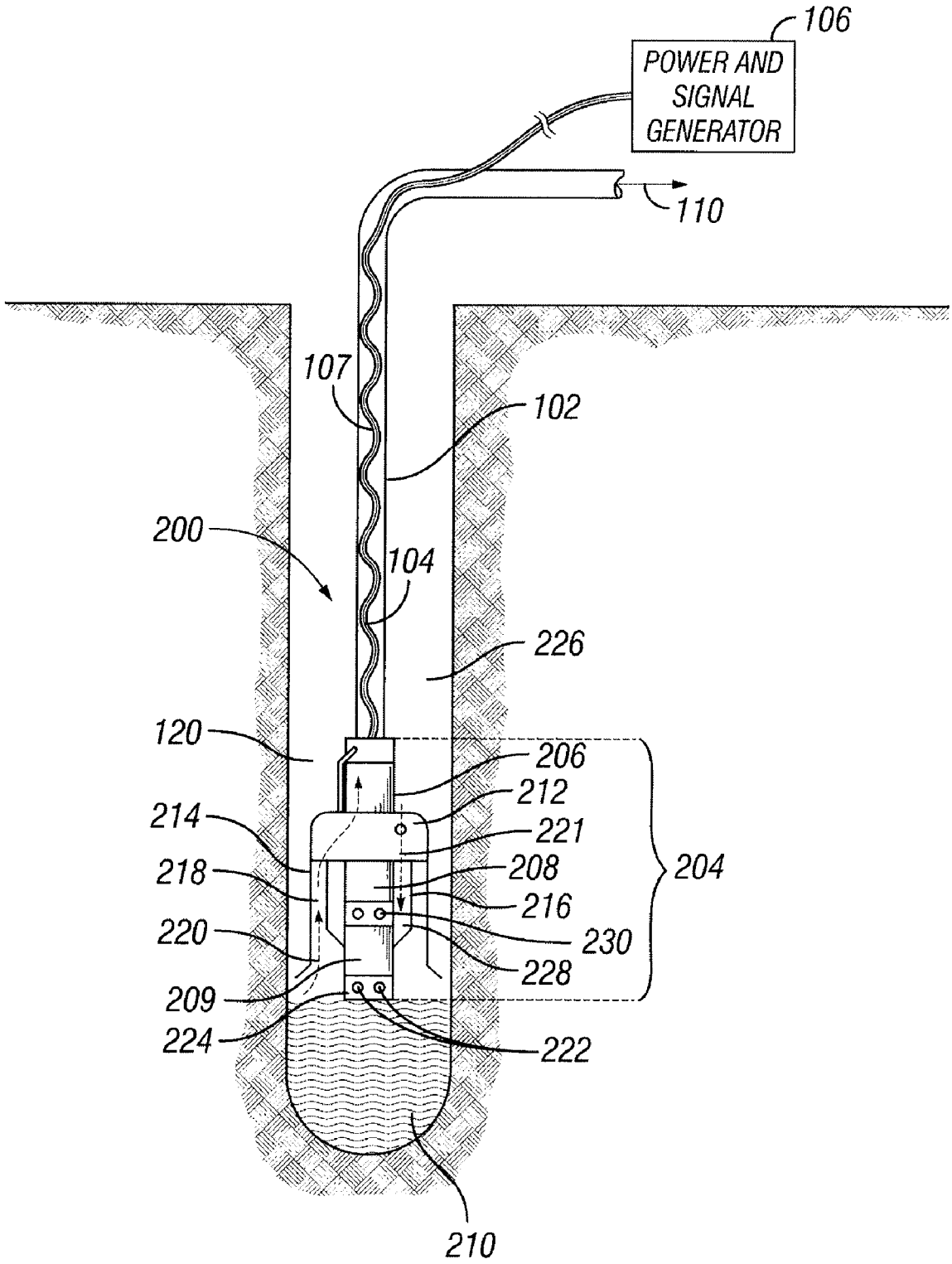
FIGS. 2-4 illustrate cleanout tools (or cleaning tools) according to other embodiments.

FIG. 2 shows an alternative embodiment of a cleaning tool 200, which includes the coiled tubing 102 and a pump assembly 204 that has two pumps 206 and 209. The first (upper) pump 206 is to provide suction to draw fluid containing debris (indicated as "fill" 210 in FIG. 2) into the inner conduit 107 of the coiled tubing 102. The pump assembly 204 includes an electrical motor 208 to actuate the pumps 206 and 209. In one implementation, the motor 208 can have a through shaft that is operationally coupled to both pumps 206 and 208 to power both pumps. The electrical motor 208 is electrically connected to the cable 104 in the coiled tubing 102.

The pump assembly 204 also includes a crossover port sub 212 that is positioned right below the upper pump 206. The crossover port sub 212 has flow paths that can cross each other. As depicted in FIG. 2, the crossover flow paths through the crossover port sub 212 are represented as an upward flow path 220 and a downward flow path 221. An outer shroud 214 and inner shroud 216 depend from the crossover port sub 212, with the outer shroud 214 having a diameter that is greater than the diameter of the inner shroud 216. The outer and inner shrouds 214, 216 define an annular flow conduit 218 between the shrouds to allow the suction provided by the upper pump 206 to draw fluid through the annular flow conduit 218 into the inner conduit 107 of the coiled tubing 202, as indicated by arrows 220.

The lower pump 209 is positioned below the motor 208, and is provided to discharge jetting fluid through jetting ports 222 of a jetting head 224. The discharge of fluids through the jetting ports of the jetting head 224 is provided to agitate the fill 210, such that debris particles in the fill 210 are suspended in fluid. The fluid containing the suspended debris particles is then drawn through the annular flow path 218 of the pump assembly 204 for flow into the coiled tubing inner conduit 107.

In some implementations, the jetting head 224 can be a rotating jetting head that rotates around the longitudinal axis of the cleaning tool 200. In a different implementation, the jetting head 224 is a fixed jetting head that does not rotate.

The jetting head 224 is one example type of an agitator assembly that can be attached to a pump assembly. The purpose of the agitator assembly is to agitate fill around the agitator assembly to enhance suspension of debris particles in fluid.

The lower pump 209 provides suction in a downward direction such that fluid in a wellbore annular region 226 (between the coiled tubing 202 and the inner wall of the wellbore 120) is drawn through the crossover port sub 212 (along path 221) into an inner annular flow conduit 228 inside the inner shroud 216. The fluid that is drawn into the inner annular path 228 can be relatively clean fluid that is provided in the wellbore annular region 226. Alternatively, the fluid drawn into the inner annular conduit 228 can be a gelled fluid that has been spotted into the wellbore annular region 226 from the earth surface. The flow into the inner annular conduit 228 flows downwardly and is drawn into inlet ports 230 at the inlet of the lower pump 209, where the fluid drawn through the inlet ports 230 is discharged through the jetting head 224 for agitating the fill 210.

Figure 3:
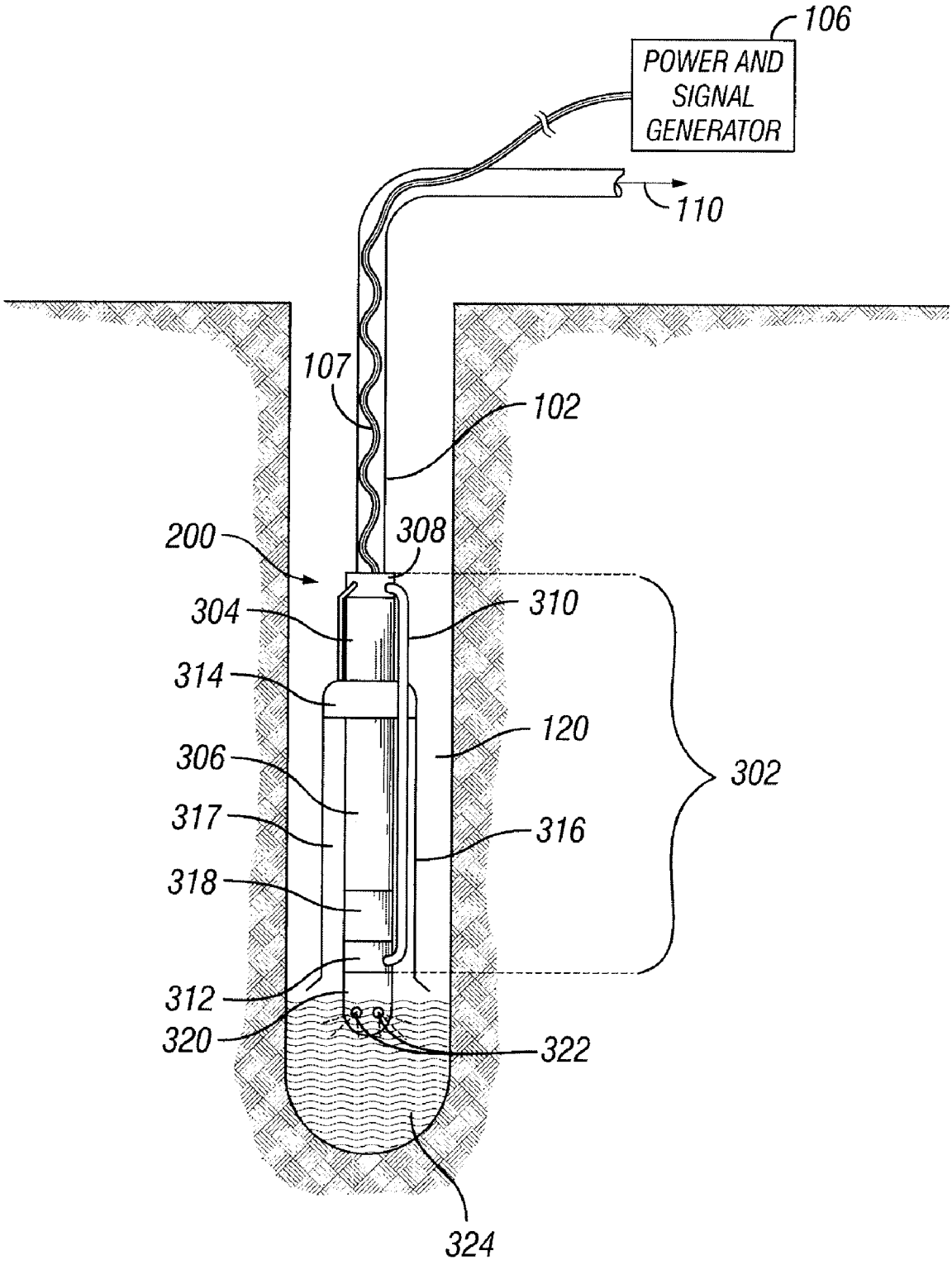

FIG. 3 illustrates a cleaning tool 300 according to yet another embodiment, which includes the coiled tubing 102 that is attached at its lower end to a pump assembly 302. The pump assembly 302 includes a pump 304 and an electrical motor 306 that is electrically connected to the electrical cable 104.

The pump assembly 302 has a discharge sub 308, below which is attached the pump 304. The discharge sub 308 is connected to a discharge conduit 310 that extends generally longitudinally from the discharge sub 308 to a flow control sub 312 that is positioned in a lower portion of the pump assembly 302. The discharge sub 308 allows for a portion of the fluid that is pumped through the pump 304 and directed to the coiled tubing inner conduit 107 to be diverted into the discharge conduit 310. Diverted fluid that flows through the discharge conduit 310 is provided back to the flow control sub 312. The flow control sub 312 has a flow control valve that can be turned on or turned off, or can be set at an intermediate setting, to control the amount of fluid that flows through the discharge conduit 310. If the flow control sub 312 is turned off, then no discharge flow occurs through the discharge conduit 310.

A shroud head 314 is connected below the pump 304. A shroud 316 depends from the shroud head 314. The motor 306 is connected below the shroud head 314. Moreover, in some implementations, a sensor assembly 318 can be connected below the motor 306. The flow control sub 312 is connected below the sensor assembly 318. In addition, a jetting head 320 is connected to the flow control sub 312 of the pump assembly 304. The jetting head 320 has jetting ports 322 through which fluid can be discharged into a fill 324 to agitate the fill 324 when the flow control sub 312 is set at an open position and the motor 306 has been activated to actuate the pump 304.

Note that the relative positions of the various components of the pump assembly 302 are provided for purposes of example. In other implementations, other arrangements of the components of the pump assembly 302 can be used.

In operation, the cleaning tool 300 is run into the wellbore 120, and the pump assembly 302 is activated by providing power and signaling over the electrical cable 104. The electric motor 306 is activated, which causes the pump 304 to draw fluid containing debris particles into an annular flow conduit 317 inside the shroud 316. The fluid flow in the annular conduit 317 is drawn into the pump 304 and directed through the discharge sub 308 into the coiled tubing inner conduit 107. The flow control sub 312 can be turned on, or can be set to an intermediate position, to allow a portion of the fluid pumped by the pump 304 toward the coiled tubing 102 to be diverted to the discharge conduit 310. The diverted fluid flows downwardly through the discharge conduit 310 and is provided through the flow control sub 312 to the jetting head 320, which produces a discharge fluid jet through jetting ports 322 to agitate the fill 324.

If the sensor assembly 318 is provided, then pressures can be monitored at various points, including point A, point B, and point C. The pressure at point A monitors the pressure at the output of the pump 304. The pressure at point B represents the pressure at the input of the pump 304. The pressure at point C represents the pressure at the jetting head 320. The pressures monitored at points A, B, and C can be used to determine if the flow control sub 312 should be turned on or off or set at some intermediate position.

Figure 4:
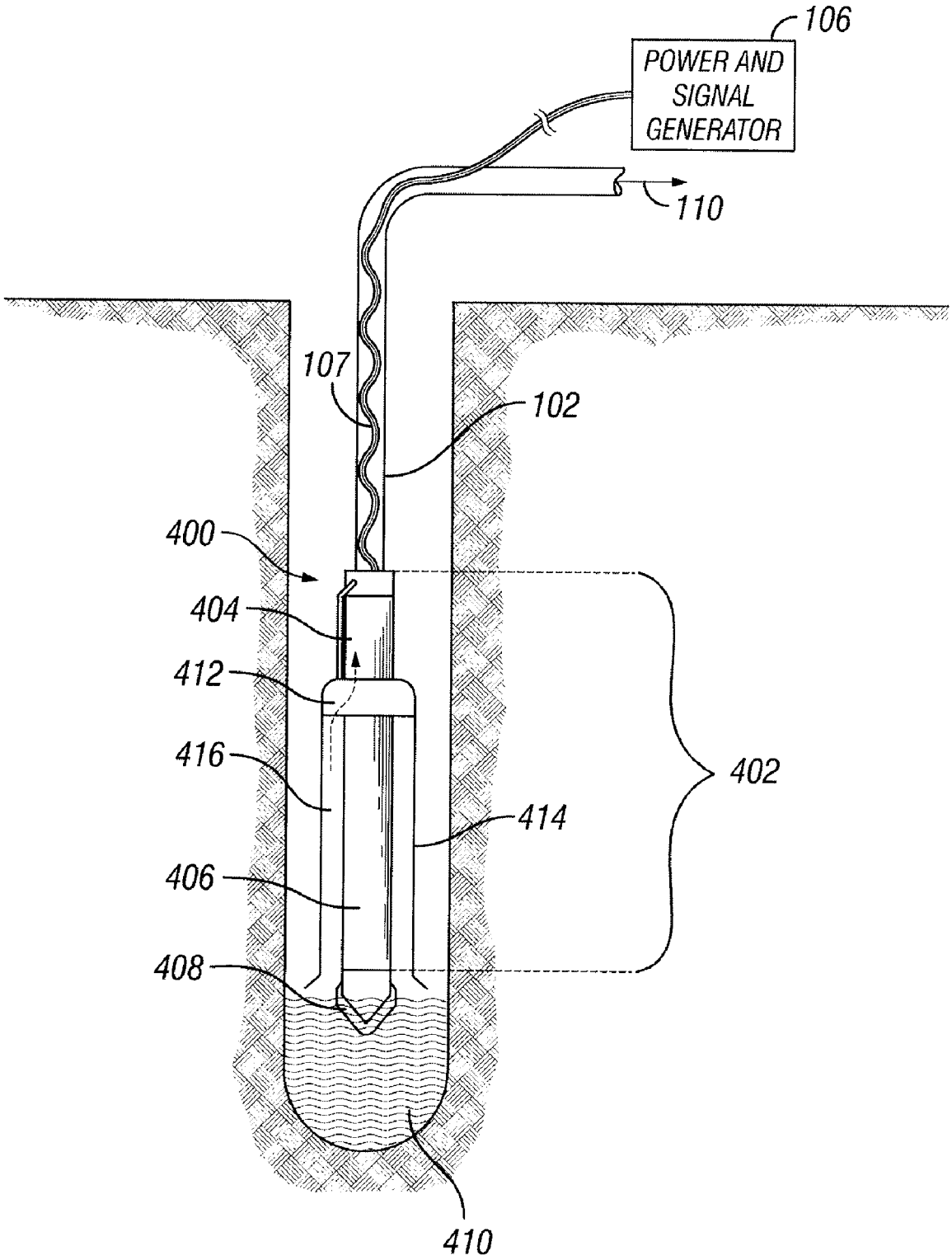

FIG. 4 illustrates a cleaning tool 400 according to yet a further embodiment that includes the coiled tubing 102 and a pump assembly 402. The pump assembly 402 includes a pump 404, an electrical motor 406 that is electrically connected to the electrical cable 104, and a shroud sub 412 attached to a shroud 414. The pump assembly 402 is attached at its lower end to a rotating agitator member 408. The motor 406 actuates both the pump 404 and the rotating agitator member 408. In one implementation, the rotating agitator member 408 can include a bladed mill, or some other type of structure that can be used to agitate a fill 410 located in the wellbore 120.

The shroud sub 412 is connected below the pump 404, and the shroud 414 depends from the shroud sub 412. An annular flow conduit 416 is defined between the shroud 414 and the outer housing of the motor 406. When the pump 404 is activated, fluid is drawn through the annular flow conduit 416 into the pump 404 and directed to the coiled tubing inner conduit 107 for flow to the earth surface. Activation of the motor 406 also causes the rotating agitator member 408 to be actuated to cause agitation of the fill 410 to suspend debris particles in fluid that is drawn into the annular path 416.

In other implementations, other arrangements of cleaning tools can be used. Individual components from the various tools depicted in FIGS. 1-4 can be combined in various different ways. For example, the sensor assembly 318 used in the FIG. 3 embodiment can be provided in the other embodiments of FIGS. 1, 2, and 4. Also, the embodiments of FIGS. 1, 2, and 4 can use the rotating agitator member 408 of FIG. 4 (in place of the jetting head used in the embodiments of FIGS. 2 and 3). Alternatively, the FIG. 4 embodiment can use a jetting head instead of the rotating agitator member 408. Numerous other modifications can also be made.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for use in a wellbore, comprising:

running a cleaning tool having a coiled tubing and an electrical pump assembly into the wellbore;

activating the electrical pump assembly that is located in the wellbore;

activating an agitator assembly to cause agitation of solid debris disposed in the wellbore downhole of the electrical pump assembly to suspend the solid debris in the fluid that is drawn into the pump assembly;

moving the cleaning tool within the wellbore to suspend the solid debris; and in response to fluid flow generated by the electrical pump assembly located in the wellbore, causing removal of solid debris from the wellbore by directing fluid containing the solid debris into the coiled tubing for flow to an earth surface.

2. The method of claim 1, wherein activating the electrical pump assembly comprises activating the electrical pump assembly that includes one of an electrical submersible pump and a progressive cavity pump.

3. The method of claim 1, where activating the agitator assembly comprises discharging jetting fluid through a jetting head and into the fill disposed downhole in the wellbore.

4. The method of claim 3, wherein discharging jetting fluid through the jetting head comprises using a pump in the electrical pump assembly.

5. The method of claim 4, wherein the pump used to discharge jetting fluid through the jetting head comprises a first pump, the method further comprising activating a second pump in the pump assembly to cause the flow of fluid containing the solid debris into the coiled tubing.

6. The method of claim 4, further comprising providing a discharge sub to selectively divert a portion of the fluid that is directed to the coiled tubing into a discharge conduit that leads to the jetting head.

7. The method of claim 6, wherein selectively diverting comprises controlling a flow control sub to control discharging jetting fluid through the jetting head.

8. The method of claim 1, wherein activating the agitator assembly comprises activating a rotating agitator member.

9. The method of claim 8, wherein activating the electrical pump assembly comprises activating an electrical motor to actuate a pump to direct the fluid flow into the coiled tubing, and wherein the rotating agitator member is also actuated by the electrical motor.

10. The method of claim 1, further comprising providing gelled fluid into the wellbore to enhance suspension of the solid debris in the fluid drawn by the pump assembly into the coiled tubing.

11. The method of claim 1, further comprising providing a power and signal generator to provide power and control signaling to the electrical pump assembly.

12. An apparatus for performing a cleanout operation in a wellbore, comprising:

a coiled tubing having an inner conduit;

an electrical pump assembly attached to a lower portion of the coiled tubing, wherein the electrical pump assembly is activatable to draw fluid containing solid debris particles into the coiled tubing inner conduit for flow to an earth surface;

an agitator assembly actuated by the electric motor, the agitator assembly to agitate the solid debris particles downhole of the electrical pump assembly to cause suspension of the solid debris particles in the fluid, the agitator assembly comprising a jetting head for discharging fluid into a fill disposed in the wellbore for agitating the solid debris particles to enable suspension of the solid debris particles in the fluid that is drawn by the pump into the coiled tubing; and a discharge sub and a discharge conduit to receive diverted fluid from the discharge sub, wherein the discharge sub selectively diverts a portion of fluid drawn by the pump into the discharge conduit, and wherein the discharge conduit directs the diverted fluid to the jetting head.

13. The apparatus of claim 12, wherein the electrical pump assembly comprises one of an electrical submersible pump and a progressive cavity pump.

14. The apparatus of claim 12, wherein the electrical pump assembly has an electric motor and a pump that is actuated by the electric motor.

15. The apparatus of claim 12, further comprising a second pump to pump the discharge fluid through the jetting head, wherein the second pump is also actuated by the electric motor.

16. The apparatus of claim 12, wherein the agitator assembly comprises a rotating agitator member that is rotated by the electric motor for mechanically agitating the debris in the wellbore downhole of the electrical pump assembly.

17. The apparatus of claim 12, wherein the coiled tubing is part of a single-coiled tubing string.

18. The apparatus of claim 12, wherein the electrical pump assembly has a shroud to define an inner annular flow conduit through which the electrical pump assembly draws fluid containing the solid debris particles.

19. The apparatus of claim 12, further comprising an electrical cable that is run along a length of the coiled tubing.

20. The apparatus of claim 19, wherein the electrical cable is provided in the inner conduit of the coiled tubing.

21. An apparatus for performing a cleanout operation in a wellbore, comprising:

a coiled tubing;

a pump assembly attached to the coiled tubing, wherein the pump assembly is activatable to draw fluid containing solid debris particles and to direct flow of the fluid containing the solid debris particles uphole in the wellbore; and an agitator assembly attached to the pump assembly for directing jetting fluid downhole through a jetting head and into a fill disposed in the wellbore below the jetting head and agitating the solid debris particles in the fill to suspend the solid debris particles in the fluid that is drawn uphole by the pump assembly.

22. The apparatus of claim 21, wherein the pump assembly comprises an electrical pump assembly having a pump and an electrical motor to actuate the pump.

23. The apparatus of claim 21, wherein the agitator assembly comprises a jetting head.

24. The apparatus of claim 21, wherein the agitator assembly comprises a rotating agitator member.

* * * * *